United States Patent [19]

Borror et al.

[11] 4,345,018

[45] Aug. 17, 1982

[54] SULFONYL-CYANO ALKANE SILVER HALIDE SOLVENTS

[75] Inventors: Alan L. Borror, Lexington; Richard B. Greenwald, Cambridge, both of Mass.

[73] Assignee: Polaroid Corporation, Cambridge, Mass.

[21] Appl. No.: 737,077

[22] Filed: Nov. 1, 1976

Related U.S. Application Data

[63] Continuation-in-part of Ser. No. 575,585, May 8, 1975, abandoned.

[51] Int. Cl.[3] ..... G03C 5/54; G03C 1/48; G03C 5/38

[52] U.S. Cl. ..... 430/234; 430/251; 430/428; 430/455; 430/456

[58] Field of Search ..... 96/29 R, 76 R, 61 R, 96/61 M, 60 B, 60 F, 95, 109, 107; 260/465.1; 430/251, 234, 428, 455, 456, 458, 459, 460

[56] References Cited

U.S. PATENT DOCUMENTS 3,769,014 10/1973 Stewart et al. ..... 430/251
3,975,423 8/1976 Borror et al. ..... 430/251

*Primary Examiner*—Richard L. Schilling
*Attorney, Agent, or Firm*—Sybil A. Campbell

[57] ABSTRACT

Alkanes containing an intralinear sulfonyl group and a cyano group separated by a single carbon substituted with at least one hydrogen atom are employed as silver halide solvents in photographic processes and compositions.

42 Claims, No Drawings

SULFONYL-CYANO ALKANE SILVER HALIDE SOLVENTS

CROSS-REFERENCE TO RELATED APPLICATIONS

This application is a continuation-in-part of our copending application Ser. No. 575,585 filed May 8, 1975, now abandoned.

BACKGROUND OF THE INVENTION

1. Field of the Invention

This invention relates to photography and, in particular, it is concerned with a new class of silver halide solvents and with photographic products, processes and compositions employing the same.

2. Description of the Prior Art

Photographic processing compositions capable of forming water-soluble complex silver salts are known to be useful in many types of silver halide photography. To obtain a relatively stable image in an exposed and developed photosensitive silver halide emulsion, the silver halide remaining in the unexposed and undeveloped areas of the emulsion should be converted to a soluble silver complex that can be removed by washing or converted to a stable silver complex that will not "print-out" upon prolonged exposure to light. In conventional or "tray" development, it is customary to fix the developed silver halide emulsion by applying a solution of silver halide solvent, i.e., silver halide complexing agent which forms a water-soluble silver complex with the residual silver halide. The water-soluble silver complex thus formed and excess silver halide solvent are then removed from the developed and fixed emulsion by washing with water.

Silver halide solvents also have been employed in monobaths where a single processing composition containing a silver halide developing agent in addition to the silver halide solvent is utilized for both developing and fixing an exposed photosensitive silver halide layer. Silver halide solvents also have been employed in diffusion transfer photographic processes. Such processes are now well known in the art; see for example, U.S. Pat. Nos. 2,543,181; 2,647,056; 2,983,606; etc. In processes of this type, an exposed silver halide emulsion is treated with a processing composition whereby the exposed silver halide emulsion is developed and an imagewise distribution of diffusible image-forming components is formed in the unexposed and undeveloped portions of the silver halide emulsion. This distribution of image-forming components is transferred by imbibition to an image-receiving stratum in superposed relationship with the silver halide emulsion to provide the desired transfer image. In diffusion transfer processes where a silver transfer image is formed, processing is effected in the presence of a silver halide solvent which forms a diffusible complex with the undeveloped silver halide. The soluble silver complex thus formed diffuses to the superposed image-receiving layer where the transferred silver ions are deposited as metallic silver to provide the silver transfer image. In preparing silver prints in this manner, the image-receiving element preferably includes a silver precipitating agent, for example, heavy metal sulfides and selenides as described in U.S. Pat. No. 2,698,237 of Edwin H. Land.

Various compounds have been employed as silver halide solvents in the photographic processes described above. One of the most commonly employed is sodium thiosulfate. Other silver halide solvents that have been used include thiocyanates, such as potassium and sodium thiocyanate; and cyclic imides, such as barbituric acid and uracil. U.S. Pat. No. 3,769,014 discloses still another class of silver halide solvents, namely, 1,1-bis-sulfonyl alkanes.

The present invention is concerned with a new class of silver halide solvents comprising alkanes that contain both a sulfonyl group and a cyano group.

SUMMARY OF THE INVENTION

It is, therefore, the primary object of the present invention to provide photographic products, processes and compositions employing a new class of silver halide solvents.

Other objects of this invention will in part be obvious and will in part appear hereinafter.

The invention accordingly comprises the processes involving the several steps and the relation and order of one or more of such steps with respect to each of the others, and the products and compositions possessing the features, properties and the relation of elements which are exemplified in the following detailed disclosure, and the scope of the application of which will be indicated in the claims.

For a fuller understanding of the nature and objects of the invention, reference should be had to the following detailed description.

DETAILED DESCRIPTION OF THE INVENTION

According to the present invention, it has now been found that open-chain alkanes containing (a) an intralinear sulfonyl group and (b) an intralinear cyano group, wherein the sulfonyl and cyano groups are separated by a single carbon substituted with at least one hydrogen atom, are useful for complexing silver ion, i.e., undeveloped silver halide in photographic processes. Compounds of this type found particularly useful in both conventional and diffusion transfer photography are those represented by the following formula:

$$R^1-SO_2-\overset{\overset{\displaystyle R^2}{|}}{CH}-CN$$

wherein $R^1$ is lower alkyl, $R^2$ is hydrogen, lower alkyl or $-(CH_2)_m S-R^3$ wherein $R^3$ is lower alkyl and m is a whole number 2 to 5. As used herein, the term "lower alkyl" is intended to mean alkyl groups containing one to four carbon atoms, for example, methyl, ethyl, propyl, isopropyl, s-butyl and n-butyl, which groups may be unsubstituted or substituted preferably in the omega position with, for example, —OH and —COOR wherein R is H or alkyl having 1 to 3 carbon atoms.

Specific examples of compounds useful as silver halide solvents in accordance with the present invention are those set out in the following formulas:

$$CH_3SO_2CH_2CN \quad (1)$$

$$CH_3SO_2\underset{\underset{\displaystyle CH_3}{|}}{CH}CN \quad (2)$$

$$CH_3CH_2SO_2CH_2CN \quad (3)$$

-continued $$CH_3SO_2CHCN \quad (4)$$
$$|$$
$$(CH_2)_2SCH_3$$

$$CH_3SO_2CHCN \quad (5)$$
$$|$$
$$(CH_2)_3SCH_3$$

$$CH_3CH_2SO_2CHCN \quad (6)$$
$$|$$
$$(CH_2)_3SCH_2CH_3$$

$$CH_3SO_2CHCN \quad (7)$$
$$|$$
$$(CH_2)_4SCH_2CH_3$$

The silver halide solvents wherein $R^2$ is $-(CH_2)_m-S-R^3$, such as, those illustrated in formulas 4 to 7 are per se novel compounds and comprise the subject matter of copending U.S. Patent Application Ser. No. 575,584 of Alan L. Borror and Richard B. Greenwald filed May 8, 1975, now U.S. Pat. No. 3,975,423 issued Aug. 17, 1976. For convenience, the specification of said application is specifically incorporated herein.

The non-S-substituted compounds may be synthesized, for example, according to the procedure reported by R. Dijkstra et al., Chem. Abstr., 49:1153 9h (1955), by reacting a sodium alkylmercaptide ($R^1SNa$) with a chloro-substituted acetonitrile (e.g., $ClCH_2CN$) to yield the corresponding thio-nitrile ($R^1SCH_2CN$) which is treated with an oxidizing agent, such as, hydrogen peroxide to give the product sulfonyl-cyano alkane ($R^1SO_2CH_2CN$). Though Dijkstra et al disclose an alkylthio-substituted compound where the —S— of the said substituent is bonded directly to the carbon atom intermediate the sulfonyl and cyano groups, the authors do not disclose the subject alkylthioalkylene-substituted compounds, and further, the subject compounds cannot be synthesized by the procedure disclosed. The subject compounds are synthesized, for example, by reacting a non-S-substituted sulfonyl-cyano compound as prepared above with the chloro-substituted derivative of the selected $R^2$ substituent, i.e., $R^3—S—(CH_2)_m—Cl$. As an example, the compound, $$CH_3SO_2CHCN,$$
$$|$$
$$(CH_2)_2SCH_3$$

was prepared as follows:

The compound, $CH_3SO_2CH_2CN$, (6.0 g., 0.05 mole) in about 30 mls. of N,N-dimethylformamide was added dropwise with stirring to a slurry of sodium hydride (57% by weight dispersion in mineral oil: 2.1 g., 0.05 mole) in 20 mls of N,N-dimethylformamide. The temperature of the mixture rose to about 50° C. accompanied by the vigorous evolution of $H_2$. The mixture was heated to maintain a temperature of about 50° C. for 20 minutes, cooled to about 35° C.; and the chloroethylmethyl was heated to maintain a temperature of about 50° C. for 20 minutes, cooled to about 35° C.; and the chloroethylmethylchloride (5.5 g., 0.05 mole) in about 10 mls. of N,N-dimethylformamide was added dropwise. No immediate reaction occurred. The reaction mixture was heated at 75°-80° C. for 3 hours and cooled followed by the careful addition of water and then ethyl ether. The organic layer was separated leaving the basic aqueous layer which was made acidic with 10% HCl and extracted twice with ethylacetate. After washing with water, the combined ethylacetate extracts were washed with water, dried over magnesium sulfate and evaporated in vacuo to leave 7.8 g. of a reddish oil. Distillation gave 4.1 g. of the title compound as a colorless oil, boiling range—165°-175° C./1 mm.

In formulating photographic processing compositions utilizing the above-described compounds, the compounds may be used singly or in admixture with each other or with other silver halide solvents. The total amount employed may vary widely depending upon the particular photographic system and should be used, for example, in a quantity sufficient for fixing a developed negative in conventional "tray" processing or in a quantity sufficient to give a satisfactory transfer print in diffusion transfer processes under the particular processing conditions employed.

Though the silver halide solvents of the present invention are broadly useful in a variety of photographic processes of the type in which water-soluble silver complexes are formed from the unreduced silver halide of a photoexposed and at least partially developed silver halide stratum, they find particular utility in diffusion transfer processes. A composition embodying the present invention specifically suitable for use in the production of transfer images comprises, in addition to the silver halide complexing agents of the above-described type, a suitable silver halide developing agent, preferably an organic developing agent. Examples of developing agents that may be employed include hydroquinone and substituted hydroquinones, such as tertiary butyl hydroquinone, 2,5-dimethyl hydroquinone, methoxyhydroquinone, ethoxyhydroquinone, chlorohydroquinone; pyrogallol and catechols, such as catechol, 4-phenyl catechol and tertiary butyl catechol; aminophenols, such as 2,4,6-triamino-orthocresol; 1,4-diaminobenzenes, such as p-phenylenediamine, 1,2,4-triaminobenzene and 4-amino-2-methyl-N,N-diethylaniline; ascorbic acid and its derivatives, such as ascorbic acid, isoascorbic acid and 5,6-isopropylidene ascorbic acid, and other enediols, such as tetramethyl reductic acid; and hydroxylamines, such as N,N-di-(2-ethoxyethyl)hydroxylamine and N,N-di-(2-methoxyethoxyethyl)hydroxylamine.

In diffusion transfer processes, the processing composition, if it is to be applied to the emulsion by being spread thereon in a thin layer, also usually includes a viscosity-imparting reagent. The processing composition may comprise, for example, one or more silver halide solvents of the present invention, one or more conventional developing agents such as those enumerated above, an alkali such as sodium hydroxide or potassium hydroxide and a viscosity-imparting reagent such as a high molecular weight polymer, e.g., sodium carboxymethyl cellulose or hydroxyethyl cellulose.

In one such transfer process, the processing solution is applied in a uniformly thin layer between the superposed surfaces of a photoexposed photosensitive element and an image-receiving element, for example, by advancing the elements between a pair of pressure-applying rollers. The elements are maintained in superposed relation for a predetermined period, preferably for a duration of 15 to 120 seconds, during which exposed silver halide is reduced to silver and unreduced silver halide forms a water-soluble, complex salt which diffuses through the layer of solution to the image-receiving element, there to be reduced to an argental image. At the end of this period, the silver halide element is separated from the image-receiving element. Materials useful in such a transfer process are described in U.S. Pat. No. 2,543,181, issued in the name of Edwin H. Land on Feb. 27, 1951, and in numerous other patents.

The photosensitive element may be any of those conventionally used in silver diffusion transfer processes and generally comprises a silver halide emulsion carried on a base, e.g., glass, paper or plastic film. The silver halide may be a silver chloride, iodide, bromide, iodobromide, chlorobromide, etc. The binder for the halide, though usually gelatin, may be a suitable polymer such as polyvinyl alcohol, polyvinyl pyrrolidone and their copolymers.

The image-receiving element preferably includes certain materials, the presence of which, during the transfer process has a desirable effect on the amount and character of silver precipitated on the image-receiving element. Materials of this type are specifically described in U.S. Pat. Nos. 2,690,237 and 2,698,245, both issued in the name of Edwin H. Land on Dec. 28, 1954 and in U.S. Pat. No. 3,671,241 issued in the name of Edwin H. Land on June 20, 1972.

Separating of the silver halide element from the image-receiving element may be controlled so that the layer of processing composition is removed from the image-receiving element of the layer of processing composition is caused to remain in contact with the image-receiving element, e.g., to provide it with a protective coating. Techniques which enable such results to be accomplished as desired are described in U.S. Pat. No. 2,647,054 issued to Edwin H. Land on July 28, 1953. In general, the processing reagents are selected so that traces remaining after the solidified processing layer has been separated from the silver image or which remain in said layer adhered as a protective coating on the silver image, as indicated above, are colorless or pale, so as not to appreciably affect the appearance of the image and to have little or no tendency to adversely react with the silver image.

The silver halide solvents of the present invention also may be employed in diffusion transfer processes adapted to provide positive silver transfer images which may be viewed as positive transparencies without being separated from the developed negative silver image including such processes adapted for use in forming additive color projection positive images. Diffusion transfer processes of this type are described in U.S. Pat. Nos. 3,536,488 of Edwin H. Land and 3,615,428 of Lucretia J. Weed and in U.S. application Ser. No. 383,196 of Edwin H. Land filed July 27, 1973. The subject compounds also find utility as silver halide solvents in diffusion transfer processes utilizing the properties of the imagewise distribution of silver ions in the soluble silver complex made available in the undeveloped and partially developed areas of a silver halide emulsion to liberate a reagent, e.g., a dye in an imagewise fashion, as described in U.S. Patent No. 3,719,489 of Ronald F. W. Cieciuch, Roberta R. Luhowy, Frank A. Meneghini and Howard G. Rogers.

To illustrate the utility of the above-defined compounds as photographic silver halide solvents, a photosensitive silver halide emulsion on a support was exposed to a step wedge and processed by spreading a layer of processing composition approximately 1.2 mils. thick between the exposed emulsion and a superposed image-receiving element comprising a layer of regenerated cellulose containing colloidal palladium sulfide carried on a transparent support. The processing composition was prepared by adding a silver solvent of the present invention in a concentration of 5% by weight to the following formulation:

| | |
|---|---|
| Water | 814.0 g. |
| Potassium hydroxide (Aqueous 50% w/w solution) | 348.0 g. |
| Hydroxyethyl cellulose | 35.0 g. |
| Zinc acetate | 15.0 g. |
| Triethanolamine | 5.6 g. |
| Bis-N,N-methoxyethyl hydroxylamine | 50.0 g. |

After an imbibition period of approximately one minute, the developed silver halide emulsion was separated from the image-receiving element, and the maximum and minimum transmission densities were measured for the positive image.

The compounds added to the base formulation as silver halide solvents, and the density measurements for the positive image obtained with each of the compounds are set forth in the following table:

TABLE

| Compound (Formula No.) | Density Maximum | Density Minimum |
|---|---|---|
| (1) | 0.74 | 0.18 |
| (4) | 2.36 | 1.76 |

In comparison, methylsulfonylacetonitriles substituted with —S—alkyl, i.e., where the sulfur atom is bonded directly to the carbon atom separating the sulfonyl and cyano groups do not function as photographic silver halide solvents. For example, the compound,

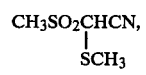

disclosed in the aforementioned reference of R. Dijkstra et al. did not exhibit silver solvent activity when employed in the above-described photographic procedure, i.e., no transfer silver density was obtained.

It will be apparent that the relative proportions of the subject silver halide solvents and of the other ingredients of the processing compositions may be varied to suit the requirements of a given photographic system. Also, it is within the scope of this invention to modify the formulations set forth above by the substitution of alkalies, antifoggants and so forth other than those specifically mentioned. Where desirable, it is also contemplated to include in the processing compositions, other components as commonly used in the photographic art.

Rather than being dissolved in the aqueous alkaline processing composition prior to application thereof to an exposed silver halide emulsion, it is also contemplated that the silver halide solvents of the present invention may be disposed prior to exposure in a layer or layers of the photographic film unit, e.g., by placing them behind a silver halide emulsion layer in the photosensitive element. In this instance, the processing composition containing the silver halide solvent is formed by application to the photosensitive element of an aqueous alkaline solution capable of solubilizing the silver halide solvent. In diffusion transfer processes, the subject silver halide solvents may be disposed in a layer or layers of the film unit but usually are contained in the processing composition.

As noted above, in diffusion transfer film units the negative component comprising at least one photosensitive layer and the positive component comprising an image-receiving layer may be in separate sheet-like elements which are brought together during processing and thereafter either retained together as the final print or separated following image formation.

Rather than the photosensitive layer and the image-receiving layer being in separate elements, they may be in the same element. In such a film unit, the image-receiving layer is coated on a support and the photosensitive layer is coated on the upper surface of the image-receiving layer. The liquid processing composition is applied between the combined negative-positive element and a second sheet-like element or spreading sheet which assists in spreading the liquid composition in a uniform layer adjacent the surface of the photosensitive layer.

Still other film units are those where the negative and positive components together may comprise a unitary structure wherein the image-receiving layer carrying the transfer image is not separated from the developed photosensitive layer(s) after processing but both components are retained together as a permanent laminate. Such film units include those for providing positive silver transfer images which may be viewed as positive color transparencies, such as, those described in aforementioned U.S. Pat. No. 3,894,871. Film units of this type also include those adapted for forming a transfer image viewable by reflected rather than by transmitted light. In addition to the aforementioned photosensitive layer(s) and image-receiving layer, such film units include means for providing a reflecting layer between the image-receiving and photosensitive layer(s) in order to mask the developed photosensitive layer(s) and to provide a white background for viewing the transfer image. This reflecting layer may comprise a preformed layer of a reflecting agent included in the film unit or the reflecting agent may be provided subsequent to photoexposure, for example, by including the reflecting agent in the processing composition. In addition to these layers, the laminate usually includes dimensionally stable outer layers or supports, at least one of which is transparent so that the resulting transfer image may be viewed by reflection against the background provided by the light-reflecting layer. Integral negative-positive film units wherein the photosensitive and image-receiving layers are retained as a permanent laminate after processing are described, for example, in U.S. Pat. No. 3,415,644 issued Dec. 10, 1968 and U.S. Pat. No. 3,647,437 issued Mar. 7, 1972, both to Edwin H. Land and in U.S. Pat. No. 3,594,165 issued July 20, 1971 to Howard G. Rogers.

It will be appreciated that in the formation of color transfer images, a dye image-providing material such as the compounds of aforementioned U.S. Pat. No. 3,719,489 may be associated with the photosensitive silver halide layer or layers of the negative component, and, usually, these and the other diffusion transfer film units described above are employed in conjunction with means, such as, a rupturable container containing the requisite processing composition and adapted upon application of pressure of applying its contents to develop the imagewise exposed film unit.

As mentioned previously, the silver halide solvents of the present invention may be initially disposed in an alkali permeable, i.e., processing composition permeable layer or layers of the film unit, for example, in the negative component in a layer other than the photosensitive silver halide layer and usually in a layer behind the photosensitive layer(s), and/or in the image-receiving component in the image-receiving layer or in another layer thereof. Usually, however, the silver halide solvent is included in the aqueous alkaline processing composition.

Since certain changes may be made in the above compositions and processes without departing from the scope of the invention herein involved, it is intended that all matter contained in the above description should be interpreted as illustrative and not in a limiting sense.

What is claimed is:

1. A photographic processing composition comprising an aqueous alkaline processing solution including therein a silver halide developing agent and as a silver halide solvent, a compound having the formula:

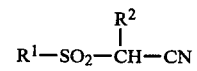

wherein $R^1$ is lower alkyl, $R^2$ is hydrogen, lower alkyl or $-(CH_2)_m S-R^3$ wherein $R^3$ is lower alkyl and m is a whole number 2 to 5.

2. A photographic processing composition as defined in claim 1 wherein $R^2$ is hydrogen.

3. A photographic processing composition as defined in claim 1 wherein $R^1$ is methyl.

4. A photographic processing composition as defined in claim 1 wherein $R^2$ is $-(CH_2)_m S-R^3$.

5. A photographic processing composition as defined in claim 4 wherein m is 2.

6. A photographic processing composition as defined in claim 4 wherein m is 3.

7. A photographic processing composition as defined in claim 2 wherein said silver halide solvent is $CH_3SO_2CH_2CN$.

8. A photographic processing composition as defined in claim 4 wherein said silver halide solvent is

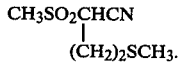

9. A photographic processing composition as defined in claim 4 wherein said silver halide solvent is

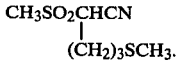

10. A photographic processing composition as defined in claim 1 which additionally includes a viscosity-increasing reagent.

11. A photographic process for forming a water-soluble complex silver salt with the unexposed and undeveloped silver halide of an imagewise exposed and developed but unfixed photosensitive silver halide layer carried on a support which comprises treating said silver halide layer with an aqueous alkaline processing composition including therein as a silver halide solvent, a compound of the formula:

$$R^1-SO_2-\overset{\overset{\displaystyle R^2}{|}}{CH}-CN$$

wherein $R^1$ is lower alkyl, $R^2$ is hydrogen, lower alkyl or $\text{-}(CH_2)_m\text{-}S-R^3$ wherein $R^3$ is lower alkyl and m is a whole number 2 to 5.

12. A photographic process as defined in claim 11 wherein $R^2$ is hydrogen.

13. A photographic process as defined in claim 11 wherein $R^1$ is methyl.

14. A photographic process as defined in claim 11 wherein $R^2$ is $\text{-}(CH_2)_m\text{-}S-R^3$.

15. A photographic process as defined in claim 14 wherein m is 2.

16. A photographic process as defined in claim 14 wherein m is 3.

17. A photographic process as defined in claim 12 wherein said silver halide solvent is $CH_3SO_2CH_2CN$.

18. A photographic process as defined in claim 14 wherein said silver halide solvent is $$CH_3SO_2\underset{\underset{\displaystyle (CH_2)_2SCH_3}{|}}{CHCN}.$$

19. A photographic process as defined in claim 14 wherein said silver halide solvent is $$CH_3SO_2\underset{\underset{\displaystyle (CH_2)_3SCH_3}{|}}{CHCN}.$$

20. A diffusion transfer photographic process comprising the steps of:

(1) reacting exposed silver halide of an imagewise exposed photosensitive silver halide emulsion layer carried on a support with a silver halide developing agent in aqueous alkaline solution;

(2) reacting unreduced silver halide of said photosensitive emulsion with as a silver halide solvent a compound of the formula $$R^1-SO_2-\overset{\overset{\displaystyle R^2}{|}}{CH}-CN$$

wherein $R^1$ is lower alkyl, $R^2$ is hydrogen, lower alkyl or $\text{-}(CH_2)_m\text{-}S-R^3$ wherein $R^3$ is lower alkyl and m is a whole number 2 to 5, said compound being capable of reacting with silver halide to form a complex silver salt that is soluble in said alkaline solution;

(3) transferring said complex silver salt to a superposed image-receiving layer; and (4) reducing said transferred complex silver salt to provide a silver image.

21. A photographic process as defined in claim 20 wherein $R^2$ is hydrogen.

22. A photographic process as defined in claim 20 wherein $R^1$ is methyl.

23. A photographic process as defined in claim 20 wherein $R^2$ is $\text{-}(CH_2)_m\text{-}S-R^3$.

24. A photographic process as defined in claim 23 wherein m is 2.

25. A photographic process as defined in claim 23 wherein m is 3.

26. A photographic process as defined in claim 21 wherein said silver halide solvent is $CH_3SO_2CH_2CN$.

27. A photographic process as defined in claim 23 wherein said silver halide solvent is $$CH_3SO_2\underset{\underset{\displaystyle (CH_2)_2SCH_3}{|}}{CHCN}.$$

28. A photographic process as defined in claim 23 wherein said silver halide solvent is $$CH_3SO_2\underset{\underset{\displaystyle (CH_2)_3SCH_3}{|}}{CHCN}.$$

29. A photographic process as defined in claim 20 wherein said aqueous alkaline solution additionally includes a viscosity-increasing reagent.

30. A photographic product which comprises a first sheet-like element comprising a photosensitive silver halide emulsion layer on a support, a second sheet-like element adapted to be superposed with said first sheet-like element and means for retaining an aqueous alkaline processing solution between said first and second sheet-like elements, at least one of said elements and said processing solution containing a silver halide solvent which forms a silver complex soluble in said aqueous alkaline solution, said silver halide solvent being a compound of the formula:

$$R^1-SO_2-\overset{\overset{\displaystyle R^2}{|}}{CH}-CN$$

wherein $R^1$ is lower alkyl, $R^2$ is hydrogen, lower alkyl or $\text{-}(CH_2)_m\text{-}S-R^3$ wherein $R^3$ is lower alkyl and m is a whole number 2 to 5, said product including a silver halide developing agent in said processing composition.

31. A photographic product as defined in claim 30 wherein $R^2$ is hydrogen.

32. A photographic product as defined in claim 30 wherein $R^1$ is methyl.

33. A photographic product as defined in claim 30 wherein $R^2$ is $\text{-}(CH_2)_m\text{-}S-R^3$.

34. A photographic product as defined in claim 33 wherein m is 2.

35. A photographic product as defined in claim 33 wherein m is 3.

36. A photographic product as defined in claim 31 wherein said silver halide solvent is $CH_3SO_2CH_2CN$.

37. A photographic product as defined in claim 33 wherein said silver halide solvent is $$CH_3SO_2\underset{\underset{\displaystyle (CH_2)_2SCH_3}{|}}{CHCN}.$$

38. A photographic product as defined in claim 33 wherein said silver halide solvent is $$CH_3SO_2\underset{\underset{\displaystyle (CH_2)_3SCH_3}{|}}{CHCN}.$$

39. A photographic product as defined in claim 30 wherein one of said first and second sheet-like elements additionally includes an image-receiving layer.

40. A photographic product as defined in claim 39 wherein said image-receiving layer is included in said second sheet-like element.

41. A photographic product as defined in claim 40 wherein said image-receiving layer is a dye image-receiving layer and said first sheet-like element additionally includes a photographically inert compound capable of undergoing cleavage in the presence of silver ions and/or soluble silver complex to liberate a diffusible dye.

42. In a photographic silver salt, chemical transfer product comprising (a) a photographic element comprising photographic silver halide, (b) a processing composition, and (c) an image receiving layer comprising development nuclei, said product comprising an organic silver halide complexing agent, the improvement wherein said silver halide complexing agent is a carbon acid of the formula:

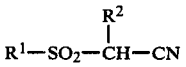

wherein $R^1$ is lower alkyl and $R^2$ is hydrogen or lower alkyl.

* * * * *